US005440777A

United States Patent [19]

Olivieri

[11] Patent Number: 5,440,777

[45] Date of Patent: Aug. 15, 1995

[54] PAINTER'S HAND TOOL

[76] Inventor: Steven M. Olivieri, 171 E. 88th St., Apt. 2C, New York, N.Y. 10128

[21] Appl. No.: 270,757

[22] Filed: Jul. 5, 1994

[51] Int. Cl.[6] ..... A47L 13/02

[52] U.S. Cl. ..... 15/236.01; 15/236.08; 30/169; D32/46

[58] Field of Search ..... 15/236.01, 236.02, 236.03, 15/236.04, 236.05, 236.06, 236.07, 236.08, 236.09; 30/169, 172; D32/46, 48, 49; D8/45, 89, 98, 105

[56] References Cited

U.S. PATENT DOCUMENTS

| | | | |
|---|---|---|---|
| 975,599 | 11/1910 | Bates | 30/169 |
| 1,388,931 | 8/1921 | Celler . | |
| 2,280,778 | 4/1942 | Andersen | 15/236.08 |
| 2,564,721 | 8/1951 | Raya | 15/236.05 |
| 2,817,863 | 12/1957 | Johns | 15/236.01 |
| 2,824,323 | 2/1958 | Tos | 15/236.05 |
| 3,203,118 | 8/1965 | Bonic | 15/236.01 |
| 3,789,450 | 2/1974 | Mozdenski | 15/236.01 |
| 3,929,345 | 12/1975 | Nasby | 15/236.01 |
| 5,008,970 | 4/1991 | Tsai | 15/236.01 |

FOREIGN PATENT DOCUMENTS

| | | | |
|---|---|---|---|
| 0683568 | 3/1964 | Canada | 15/236.01 |

*Primary Examiner*—David A. Scherbel
*Assistant Examiner*—Randall E. Chin
*Attorney, Agent, or Firm*—Martin J. Spellman, Jr.

[57] ABSTRACT

A tool for scraping paint from surfaces having a blade and handle fastened to a tang end of the blade. The blade has symmetrical side edges extending forwardly and outwardly from the tang to angular outer corners and a V-shaped recess formed at the center of the blade between the outer corners. Central edges extend forwardly from an apex of the recess to inner corners. The central edges form an angle from 30° to 60° where they are joined at the apex. Middle edges extend outwardly and rearwardly from the inner corners to angles formed between the middle central edges and intermediate edges. The intermediate edges extend outwardly to the blade's outer corners at an angle perpendicular to the longitudinal axes of the blade. The blade is particularly useful in removing paint from rough surfaces or paint that is unusually thick.

4 Claims, 1 Drawing Sheet

PAINTER'S HAND TOOL

BACKGROUND OF THE INVENTION

1.Field of the Invention

The present invention concerns a hand held tool for scraping paint away from surfaces. It is particularly applicable for exterior surfaces with very thick paint layers.

2.Prior Art

There is no prior art of which Applicant is aware which discloses or suggests the scraper of the present invention. The following references are the most closely related prior art of which the Applicant is aware.

U.S. Pat. No. Des. 208,190, Parry relates to a hand held scraper having a blade with a centrally located crescent and two angular protrusions.

U.S. Pat. No. 3,789,450, Mozdenski et al. discloses a painter's tool having a generally triangular shaped metal blade, a portion of one edge thereof having protruding angular shaped teeth.

U.S. Pat. No. 1,388,931, Celler discloses a combined scraper and chopper for scraping floors to remove dirt, paint, ice and other materials. In this reference, a series of beveled chopping edges are formed on one edge of a reversible blade and which is notched or has an interrupted edge.

U.S. Pat. No, 2,817,863, Johns discloses a metallic cleat cleaner which has a series of notches in a scraping blade to accommodate the cleats.

SUMMARY OF THE INVENTION

The present invention provides a handle tool for scraping paint from a surface as particularly useful for scraping paint from an exterior surface covered with multiple layers of tenacious paint. It provides a means for scoring the layers of paint to facilitate their removal as well as means for loosening paint surfaces that have intricate contours.

The particular scraping tool of the present invention is comprised of a blade, usually steel, having a rear tang at its proximal end which is secured in a non-metallic handle which is usually of two pieces which are fastened together with fastening means passing through the tang of the blade. The side edges of the blade extend outwardly of the longitudinal axis of the blade and forwardly from the proximal end of the blade at the tang and terminate at forward outer corners at the distal end of the blade.

The forward or distal end portion of the blade between the outer corners has a V-shaped recess formed therein at the central portion of the blade along the longitudinal axis of the blade with the central edges forming the sides of the V-shaped recess extending forwardly from the apex of the recess at an angle of about 30° to 60° preferably 45° between them where they join at the apex. The edges of the recess terminate at their forward ends at inner corners which are formed between the recess edges and middle edges that extend outwardly and slightly rearwardly from said inner corners to angles formed between the middle edges and outward intermediate edges. The intermediate edges extend outwardly to the blade's outer Corners at an angle perpendicular to the longitudinal axis of the blade.

Alternately, the intermediate edges extend outwardly and slightly forwardly at an angle of 5° to 10° from a perpendicular to the longitudinal axis of the blade.

The tool is extremely useful in removing thick weathered layers of paint on exterior surfaces.

When using the tool for scraping paint on a relatively even surface, the user will hold the blade at about a twenty degree angle to the surface being scraped. At the angle of attack, the blade functions in substantially the same manner as a scraper blade in which the front edge is straight.

When unusually tough multiple layers of firmly adhered paint are encountered, the angle of attack of the blade is increased so that the scraper edges bite more deeply into the paint layer. The corners can furrow into the paint layer breaking it up and possibly facilitating removal from complex surfaces. Providing the angle of attack is kept low, there is substantially no rise of inadvertent or unnecessary gouging of the underlying surface particularly if the user gains dexterity and experience in using the tool.

BRIEF DESCRIPTION OF THE DRAWING

In the accompanying drawing which forms a part of this specification.

ILLUSTRATIVE SPECIFIC EMBODIMENT

Referring to the accompanying drawing, the tool of the present invention is shown and indicated by the numeral 2 and is comprised of a blade 4 and handle 6.

Figure 1:
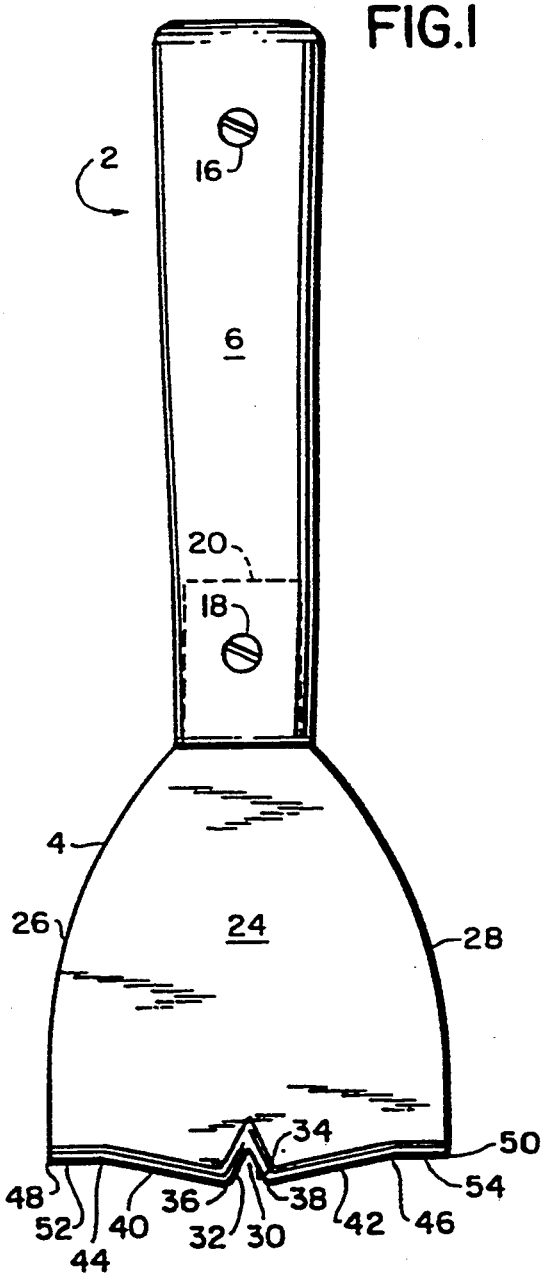
FIG. 1 is a plan view of the tool including handle and scraper blade.
Figure 2:
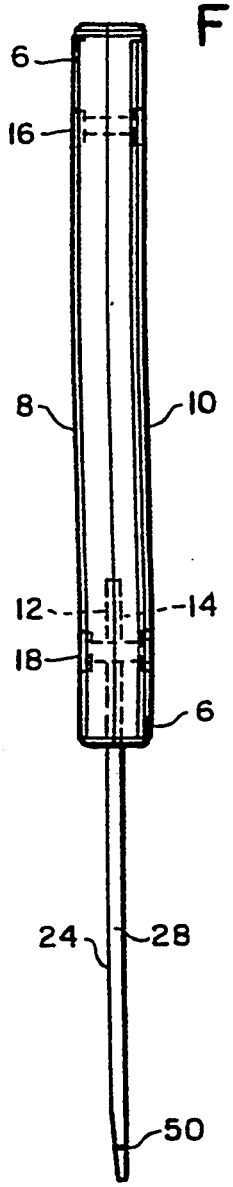
FIG. 2 is a side view of the tool shown in FIG. 1.
Figure 3:
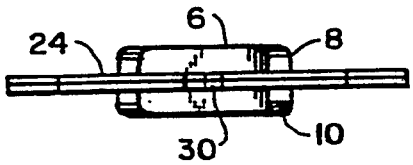
FIG. 3 is a front plan view of the tool.

As best shown in FIGS. 1 and 2, the handle 6 includes a first half 8 and a second half 10 having recesses 12 and 16 respectively at the blade end to accommodate the thickness of the blade 4 at the front, end of the handle halves 8 and 10. The two halves 8 and 10 of the handle 6 are joined together by fasteners 16 and 18, the latter passing through an aperture 22 in the tang 20 of the blade 4. The flat blade 4 is formed of a body 24 having curved symmetrical sides 26 and 28 which curve outwardly from the tang 20 at the proximal end of the blade 4 handle to the outer corners 48 and 50 at the distal end of the blade 4.

The center of the blade 4 has a V-shaped recess formed therein with the apex 30 and edges 32 and 34 or sides of the recess forming an angle of approximately 30° to 60° between them. In the example, the angle is approximately 45°. Central edges 32 and 34 extend forwardly towards the distal end to form inner corners 36 and 38 with the middle edge sections 40 and 42 that extend laterally outwardly and rearwardly as shown to form angles 44 and 46 respectively with intermediate edges 52 and 54 which are generally perpendicular to the longitudinal axis of the tool 2. Intermediate edges 52 and 54 terminate at the 90° corners 48 and 50 respectively with sides 26 and 28.

Figure 4:
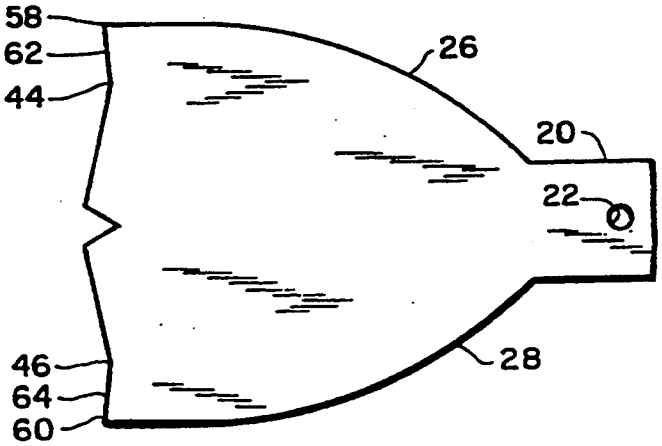
FIG. 4 is a plan view of the blade of an alternate embodiment of the tool.

In the alternative embodiment shown in FIG. 4, the edge sections 62 and 64 between the angles 44 and 46 and corner 58 and 60, respectively, are oriented at 5°–10°, preferably about 5°, forward of a perpendicular to the longitudinal axis of the tool 2 with the edges 26 and 28, respectively.

The handle 6 parts 8 and 10 are usually made of wood or a hard plastic. The blade 4 is usually made of steel, however, many alternative materials can be substituted by those skilled in the art.

The tool 2 is very useful in removing thick layers of paint, especially from exterior surfaces.

When using the tool 2 for scraping paint on a relatively even surface, the user will hold the blade 4 at about a twenty degree angle to the surface being scraped. At that angle of attack, the blade 4 functions in substantially the same manner as a scraper blade in which the front edge is straight.

Where the user encounters rough surfaces or unusually resistant adhesion and/or thick layers of paint, the angle of attack should be increased so that the edges, especially 40 and 42, bite more deeply into the paint layer. In addition, the points 36 and 38 will furrow into the paint layer and into concentrated contact with the surface being scraped as the angle of attack is increased. This serves to score and break up the paint layer effectively. As the angle of attack is raised, the possibility of scoring the underlying surface increases. The tool is most useful on exterior surfaces.

Providing the angle of attack is kept low, there is substantially no risk of inadvertent gouging. As the user acquires dexterity in use of the tool, the risk of inadvertent gouging of the underlying surface decreases, and with the practice it may be used on interior surfaces.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A tool for scraping paint from surfaces comprising an elongated handle having a proximal end and a distal end, a flat blade having symmetrical edges, a longitudinal axis, a proximal end and a distal end, and a tang at said proximal end of said blade said distal end of said handle fastened to said tang at said proximal end of said blade, said symmetrical side edges of said blade extending forwardly from said proximal end of said blade and outwardly from said longitudinal axis of said blade to angular outer corners at the distal end of said blade, a V-shaped recess having central edges forming an apex at a center of said distal end of said blade, said central edges at said distal end of said blade forming an angle of from 30 to 60 degrees where joined at said apex of said recess and extending forwardly from said apex of said v-shaped recess to inner corners, said distal end of said blade being further defined by middle edges extending slightly rearwardly and outwardly from said inner corners to said outer corners approximately perpendicularly to said longitudinal axis of said blade.

2. A tool as claimed in claim 1 wherein the angle between said central edges is about 45°.

3. A tool for scraping paint from surfaces, said tool comprising a handle, a blade having a symmetrical side edges, a longitudinal axis, a proximal end and a distal end, and a tang at said proximal end of said blade, said handle fastened to said tang at said proximal end of said blade, said symmetrical side edges of said blade extending forwardly and outwardly from said tang of said blade to angular outer corners at the distal end of said blade, a V-shaped recess having central an forming apex at a center of said distal end of said blade between said outer corners, said central edges extending forwardly from said apex of said recess to inner corners, said central edges forming an angle of from 30 to 60 degrees where joined at said apex, said distal end of said blade being further defined by middle edges extending outwardly and slightly rearwardly from said inner corners to intermediate edges, said intermediate edges extending from said middle edges outwardly and forwardly to said blade outer corners at an angle of from 5° to 10° from an axis perpendicular to said longitudinal axis of said blade.

4. A tool as claimed in claim 3 wherein the angle between said central edges is about 45°.

* * * * *